United States Patent [19]

Nahill et al.

[11] 3,931,885

[45] Jan. 13, 1976

[54] MEDICINE DISPENSING SYSTEM

[76] Inventors: Edmond P. Nahill, 56 Pleasant St.; James C. Nahill, 9 Sunset Ave.; William A. Nahill, 10 Glen Ave.; Arthur Nahill, 51 East St., all of, Methuen, Mass. 01844

[22] Filed: Apr. 30, 1973

[21] Appl. No.: 355,960

[52] U.S. Cl. ..... 206/44 R; 40/124; 116/121; 206/466; 206/538; 206/820; 312/184

[51] Int. Cl.[2] ..... B65D 5/52; B65D 73/00

[58] Field of Search ..... 40/124, 308, 312, 104.1, 40/104.14, 10 R, 359, 360, 128; 211/46, 50, 71; 312/234.1–234.5; 116/121; 206/461, 44, 45.11, 45.12, 45.14, 466, 438, 820, 806

[56] References Cited

UNITED STATES PATENTS

| | | | |
|---|---|---|---|
| 865,795 | 9/1907 | McKenna | 40/124 |
| 2,816,666 | 12/1957 | Nadel | 206/461 |
| 2,833,402 | 5/1958 | Lefebvre | 206/466 |
| 3,099,352 | 7/1963 | Auen | 40/107 |
| 3,249,111 | 5/1966 | Vincens | 211/46 |
| 3,281,193 | 10/1966 | Murray | 211/46 |
| 3,515,265 | 6/1970 | Bartnik | 116/121 |
| 3,730,738 | 5/1973 | Cook et al. | 312/184 |
| 3,749,237 | 7/1973 | Dorton | 206/438 |
| 3,773,250 | 11/1973 | Phillips | 116/112 |
| 3,827,571 | 8/1974 | Koutny | 211/59 |

FOREIGN PATENTS OR APPLICATIONS

| | | | |
|---|---|---|---|
| 1,441,164 | 4/1966 | France | 211/46 |
| 1,450,780 | 7/1966 | France | 211/46 |

*Primary Examiner*—William I. Price
*Assistant Examiner*—Allan N. Shoap
*Attorney, Agent, or Firm*—Pearson & Pearson

[57] ABSTRACT

A novel packaging system for use in packaging and distributing medicines, comprising a portable means supporting a plurality of packages in vertical, depending position, these packages having a flimsy, non self-supporting, sheet forming a lower, compartmentalized, medicine-holding means and also having, integrally connected to the package, an upstanding, upper, label of relatively rigid, self-supporting cardboard, which includes downwardly facing bearing surfaces formed by the laterally projecting bottom edges of the label for cooperation with, and to facilitate suspension on, the aforesaid portable apparatus.

1 Claim, 4 Drawing Figures

FIG. 1.
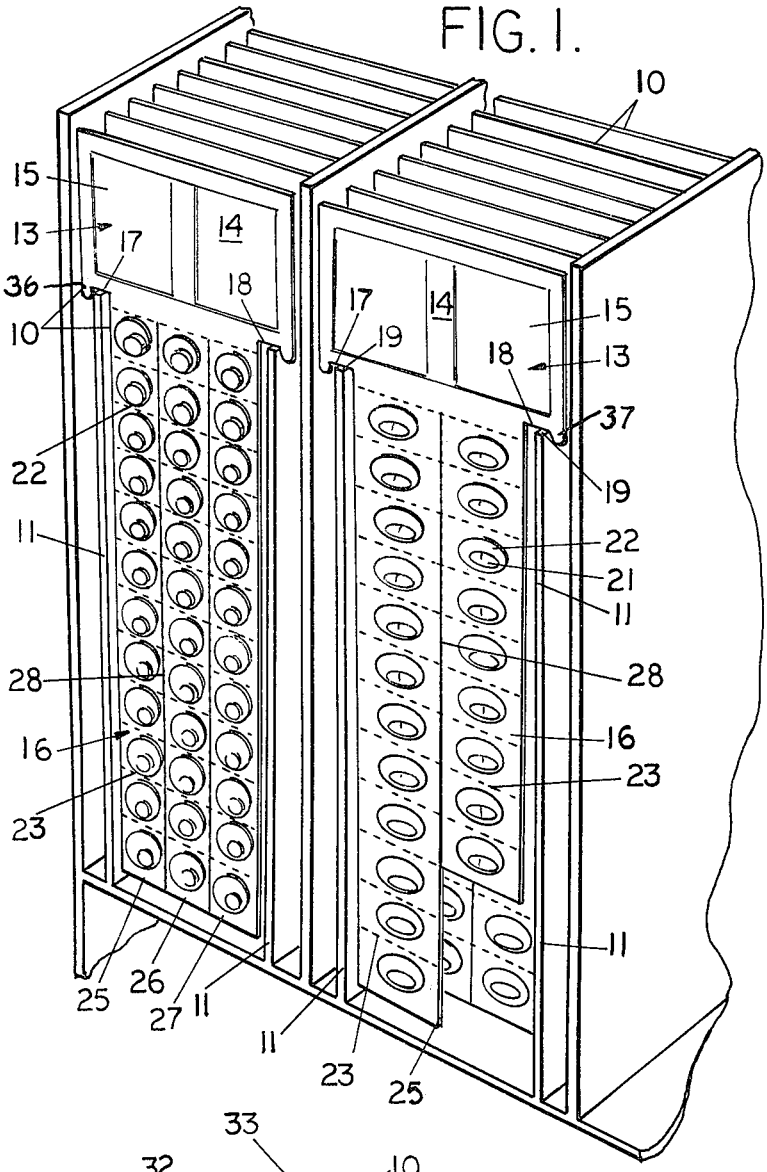
FIG. 2.
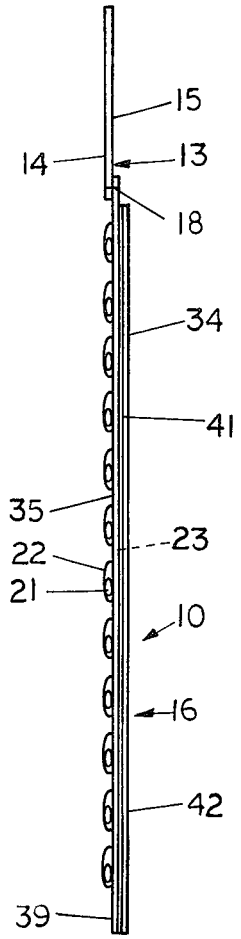
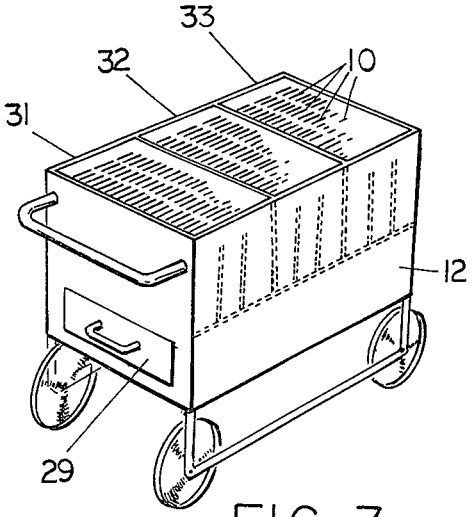
FIG. 3.
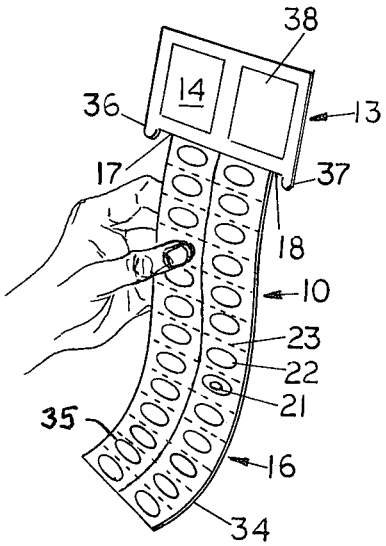
FIG. 4.

MEDICINE DISPENSING SYSTEM

BACKGROUND OF THE INVENTION

There has been a problem to provide drug distribution and control systems for use in nursing homes, hospitals, and the like, wherein the nurse or attendant circulates through the installation dispensing pills or other medicines to the patients. The most commonly used form of medicine dispensing at the present time in such institutions is the use of a small paper cup with the patient's name written on it and the medicine put into it, usually in pill, tablet or capsule form. Such cups are neither convenient nor particularly safe. For example, they are subject to upset, mix-up or spilling, and they require several trips to the hospital dispensary because only a limited number of cups can be handled with convenience at one time.

A number of partial solutions have been suggested for solving this problem. For example, in U.S. Pat. No. 3,182,791 to Jenner, there is suggested a strip-like, compartmentalized package for use together with date insignia and the dispensation of medicines. Similar packaging devices are disclosed in U.S. Pat. No. 3,283,885 to Grunewald and Lindner, and U.S. Pat. No. 3,347,358 to Meyers. In general, therefore, it has heretofore been proposed to use blister-type medicine packaging in combination with prescription-type data and to use such items to meet the special problems associated with dispensing of medicines in nursing homes and hospitals.

However, while these prior art packaging devices are useful as individual packages, they are not adapted for maintaining an ordered and visible index of the prescription information for a large number of patients.

SUMMARY OF THE INVENTION

Therefore, it is a principal object of the present invention to provide an inexpensive and convenient medicine-dispensing system wherein compartmentalized medicine-holding packages, partly of flimsy, non self-supporting material are arranged vertically with information permanently visible at the top of the package, independently of the amount of medication that has been removed from the lower suspended portion of the package.

It is a further object of the invention to provide an improved, flexible, easily-handled, medicine-dispensing package of the blister-type which contains an upper card to hold the prescription-bearing portion of the element in a rigid upright position, despite the lower portion being formed of low cost, flimsy, sheet material.

A further object of the invention is to provide a portable means for moving, supporting and displaying a plurality of the medicine-bearing elements of the invention.

Other objects of the invention will be obvious to those skilled in the art on reading the instant application.

The above objects have been substantially achieved by the provision of a system comprising a novel medicine-holding package consisting of a lower, advantageously flexible, sheet like element, having about thirty medicine-containing compartments and having an upper display portion attached to the medicine bearing sheet, but formed of self-supporting material. The display section comprises space for receiving the patient's name, the kind of medicine that is to be used, and other such prescription information, and also includes laterally projecting bottom edges forming at least one downward facing support surface and forming means to cooperate with a package support means on which a plurality of the medicine-bearing elements may be carried. Thus the packages are suspended in such a way that flimsy packaging material can be used to facilitate medicine removal without interfering with stable positioning of the information-bearing part of the package. No superstructure, racks, posts, etc. obstruct access by the nurse in quickly grasping and withdrawing the card from a cart for dispensing a pill.

ILLUSTRATIVE EMBODIMENT OF THE INVENTION

In this application and accompanying drawings there is shown and described a preferred embodiment of the invention and suggested various alternatives and modifications thereof, but it is to be understood that these are not intended to be exhaustive and that other changes and modifications can be made within the scope of the invention. These suggestions are selected and included for purposes of illustration in order that others skilled in the art will more fully understand the invention and the principles thereof and will be able to modify it in a variety of forms, each as may be best suited in the condition of a particular case.

IN THE DRAWINGS

FIG. 1 is a fragmentary perspective view of the medicine-bearing packages of the invention, supported in vertical, depending position;

FIG. 2 is a side elevational view of one of the medicine-bearing packages of the invention;

FIG. 3 is a perspective view of the portable indexing system of the invention comprising a plurality of bubble-type cards mounted in a cart-like vehicle; and FIG. 4 is a perspective view of one of the cards of the invention, illustrating the ease of handling of the medicine holding package.

Referring to FIG. 1, it is seen that a plurality of medicine-bearing packages 10 are mounted on upright support members 11 of a portable cart 12. The upper portion 13 of each package 10 comprises an index card 14 of self-supporting sheet material, such as cardboard, bearing basic prescription data, such as name of patient, dosage, identification of medicine, etc. The card 14 is of predetermined width and extends outwardly beyond the lateral limits of the flimsy medicine-bearing lower portion 16 depending centrally therebelow to provide a pair of downwardly facing bearing surfaces 17 and 18 which bear against the horizontal upper edges 19 of parallel support members 11 and hold the prescription information in the desired visible position as medicine is incrementally removed from the bottom of the lower portion 16. Medicine, such as pills 21, is advantageously held within plastic bubbles, or blisters, 22 and the bubbles are separated by perforated tear lines 23.

Preferably, each pill card 10 is provided with about thirty bubbles 22, one for each day of the month, arranged in three rows, such as 25, 26, and 27, separated by slits, such as 28. The bubbles in each row are individually and successively removable from the bottom to the top on the perforated tear lines 23 until the upper portion 13 is reached and the card is empty and disposed of. It will be understood that if the entire card were of limp, flimsy material, it would slip to the bottom of a container and any upper label would sink lower in the receptacle as pill bubbles were removed from the bottom, upwardly.

In this invention, the lower portion 16 of the card may be of limp non-self-supporting, low-cost sheet material, such as thin plastic film and foil layers, so that it is disposable but is supported with the upper portion 13 always at visible height despite the daily removal of pill bubbles from the lower portion.

In FIG. 1, a pill card 10 is shown with a few bubbles removed to illustrate the manner of use of the invention.

FIGS. 3 and 4 illustrate how conveniently the packages 10 of the invention may be handled. The portable support system of FIG. 3 comprises cart 12 having a drawer 29 and divided into a plurality of compartments 31, 32, and 33, each compartment supporting in depending position a large number of packages 10 with the cards 14, of the upper portions 13, arranged to be continually visible.

In FIG. 4, it is seen how the lightweight construction and the flexibility of the pill-dispensing card 10 is useful in permitting the easy removal of a pill-type dosage by pushing the pill with thumb pressure through the moisture-proof backing sheet 34 by pressure on the transparent plastic film cover ply 35. Such light, flexible construction of medicine-bearing sheets would be impractical for the purposes intended, were it not for the supporting means formed of the data-bearing index card members 14, support partitions 11, and cart 12.

FIG. 2 shows more details of the construction of pill card 10, wherein index card 14 is shown to consist of a relatively rigid, self-supporting material, such as cardboard or plastic, and bearing ears 36 and 37. The downwardly projecting ears 36 and 37 are each outside one of the downward facing bearing surfaces 17 or 18 and prevent twisting and dislodgment of the cards. On the back of card 14 has been permanently fastened a data sheet 38, which sheet bears the prescription indicia. Lower portion 16 comprises a vacuum-formed, blister type, molded front ply 39, an adhesive layer 41, and a foil or plastic cover ply 42 fixed by the adhesive 41 to the front ply 39. It is advantageous if card 14 and ply 39 are integrally molded from the same plastic sheet, card 14 being of a self-supporting thickness.

It will be recognized that certain coding techniques known to the art can also be used with the system of the invention. Thus each blister 22 can be identified with a specific date designation, color-coding can be used on the data card, etc. A particular advantage of the device of the invention is that it can be utilized with color coding, whereby cover ply 42 can be colored to identify a particular kind of medicine and data sheet 38 can be color-coded with the same confirmatory color, or a different color, indicating dosage rate, hospital ward, or some other such useful information.

It is also to be understood that the following claims are intended to cover all of the generic and specific features of the invention herein described and all statements of the scope of the invention which might be said to fall therebetween.

We claim:

1. In combination:

a portable cart having side and end walls, at least one compartment formed therein, each compartment having at least two parallel upright support members, extending vertically therein, and having parallel horizontal upper edges spaced a predetermined width apart, and a plurality of compartmentalized medicine-holding packages, each package comprising a generally T-shaped body having a lower, medicine-carrying portion of flexible, low-cost, non self-supporting materials having bubbles therealong, for containing a pill, separated by the tear lines, for permitting each successive lowermost bubble to be separated therefrom, said sheet being of less width than the width between said supports to hang therebetween and an upper index card portion of relatively rigid, self-supporting, material of predetermined greater width than the width of said lower portion and than the width between said supports; said card having a pair of oppositely disposed, downward facing bottom edges each forming a bearing surface extending beyond the said horizontal edges of said supports and supported thereon and having a pair of integral downward projecting ears, each outside one of the bearing surfaces of said bottom edges;

said bearing surfaces supporting said card portion in visible, upright, readable position; supporting said lower portion in limp, depending position between said supports and supporting said packages for individual free removal from said cart in a vertical path and said ears preventing inadvertent twisting and dropping of said packages to the bottom of said cart.

* * * * *